US010443261B2

(12) United States Patent
Jaeger

(10) Patent No.: US 10,443,261 B2
(45) Date of Patent: Oct. 15, 2019

(54) MAUSOLEUM WITH SEALED CYLINDER ASSEMBLIES

(71) Applicant: David A. Jaeger, Oregon, OH (US)

(72) Inventor: David A. Jaeger, Oregon, OH (US)

( * ) Notice: Subject to any disclaimer, the term of this patent is extended or adjusted under 35 U.S.C. 154(b) by 189 days.

(21) Appl. No.: 15/642,788

(22) Filed: Jul. 6, 2017

(65) Prior Publication Data

US 2019/0010724 A1 Jan. 10, 2019

(51) Int. Cl.

| | |
|---|---|
| ***E02D 35/00*** | (2006.01) |
| ***E04H 13/00*** | (2006.01) |
| ***E04B 1/19*** | (2006.01) |
| ***E04B 7/02*** | (2006.01) |
| ***E04D 13/03*** | (2006.01) |
| ***E04H 9/02*** | (2006.01) |
| ***E04F 13/072*** | (2006.01) |

(52) U.S. Cl.

CPC ..... *E04H 13/006* (2013.01); *E04B 1/19* (2013.01); *E04B 7/022* (2013.01); *E04D 13/03* (2013.01); *E04F 13/072* (2013.01); *E04H 9/024* (2013.01); *E04B 2103/06* (2013.01)

(58) Field of Classification Search

CPC ..... A61G 17/08; E04H 13/00; E04H 13/006; E04H 1/005; E04H 13/008; E04B 1/19; E04B 1/24; E04B 1/1906

USPC ..... 52/134, 136, 128, 135, 137, 125.2; 27/35, 1

See application file for complete search history.

(56) References Cited

U.S. PATENT DOCUMENTS

| | | | | | |
|---|---|---|---|---|---|
| 1,012,893 | A | * | 12/1911 | Moore | E04H 13/005 454/359 |
| 1,096,758 | A | * | 5/1914 | Rogers | E04H 13/005 52/132 |
| 1,752,572 | A | * | 4/1930 | Person | E04H 13/006 52/134 |
| 3,408,711 | A | | 11/1968 | Pauliukonis | |
| 3,529,730 | A | * | 9/1970 | Thompson | E04H 13/006 211/1 |
| 4,669,157 | A | | 6/1987 | Schwarten | |
| 4,875,805 | A | * | 10/1989 | Gross | B09B 1/00 405/129.57 |
| 6,161,268 | A | * | 12/2000 | Joseph | E04H 13/006 27/1 |

(Continued)

FOREIGN PATENT DOCUMENTS

| | | | |
|---|---|---|---|
| CA | 2762740 | A1 | 7/2012 |
| JP | 11113985 | A | 4/1999 |

*Primary Examiner* — Chi Q Nguyen

(74) *Attorney, Agent, or Firm* — MacMillan, Sobanski & Todd, LLC

(57) ABSTRACT

A mausoleum is provided. The mausoleum includes a base configured to connect the mausoleum to a ground area. A first framework is supported by the base. The first framework is configured to support a plurality of cylinder assemblies. The first framework includes a plurality of corner posts, main posts, header members and bracing members. A second framework extends from the first framework and is configured to support a roof structure. The second framework includes a plurality of truss structures. A cupola extends from the second framework. The plurality of cylinder assemblies, corner posts, main posts, header members, bracing members and truss structures are formed from metallic materials configured to be resistant to weather and seismic activity.

18 Claims, 9 Drawing Sheets

(56) References Cited

U.S. PATENT DOCUMENTS

| | | | | |
|---|---|---|---|---|
| 6,167,600 | B1 * | 1/2001 | Williams | E04H 13/006 27/1 |
| 6,250,025 | B1 | 6/2001 | Darby | |
| 7,739,776 | B2 * | 6/2010 | Hume | E04H 13/008 27/1 |
| 8,925,278 | B2 * | 1/2015 | Sugihara | E04B 1/58 52/167.3 |
| 9,080,344 | B2 | 7/2015 | Young et al. | |
| 9,249,598 | B2 | 2/2016 | Bridgeman et al. | |
| 9,458,643 | B2 | 10/2016 | Young et al. | |
| 2006/0053604 | A1 | 3/2006 | Brine | |
| 2008/0178551 | A1 * | 7/2008 | Porter | E04B 1/24 52/653.1 |
| 2009/0071091 | A1 * | 3/2009 | Ode | A01G 9/14 52/653.1 |
| 2011/0154745 | A1 * | 6/2011 | Clifton | H01Q 1/1235 52/32 |
| 2011/0154748 | A1 * | 6/2011 | Young | E04H 13/006 52/136 |

* cited by examiner

MAUSOLEUM WITH SEALED CYLINDER ASSEMBLIES

BACKGROUND

A mausoleum is typically a free-standing building, constructed as a monument, for enclosing the burial space of one or more deceased persons. In certain embodiments, a mausoleum can include a plurality of internal compartments, each spaced apart and defined by construction members and configured to receive vessels containing the remains of one or more deceased persons.

In certain embodiments, the mausoleum can be a framed structure, enclosed with aesthetically pleasing and weather-resistant exterior materials, such as for example stone and/or concrete panels and the like.

It would be advantageous if mausoleums could be improved.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the mausoleum with sealed cylinder assemblies.

The above objects as well as other objects not specifically enumerated are achieved by a mausoleum. The mausoleum includes a base configured to connect the mausoleum to a ground area. A first framework is supported by the base. The first framework is configured to support a plurality of cylinder assemblies. The first framework includes a plurality of corner posts, main posts, header members and bracing members. A second framework extends from the first framework and is configured to support a roof structure. The second framework includes a plurality of truss structures. A cupola extends from the second framework. The plurality of cylinder assemblies, corner posts, main posts, header members, bracing members and truss structures are formed from metallic materials configured to be resistant to weather and seismic activity.

Various objects and advantages of the mausoleum with sealed cylinder assemblies will become apparent to those skilled in the art from the following detailed description, when read in light of the accompanying drawings.

DETAILED DESCRIPTION

The mausoleum with sealed cylinder assemblies will now be described with occasional reference to the specific embodiments. The mausoleum with sealed cylinder assemblies may, however, be embodied in different forms and should not be construed as limited to the embodiments set forth herein. Rather, these embodiments are provided so that this disclosure will be thorough and complete, and will fully convey the scope of the mausoleum with sealed cylinder assemblies to those skilled in the art.

Unless otherwise defined, all technical and scientific terms used herein have the same meaning as commonly understood by one of ordinary skill in the art to which the mausoleum with sealed cylinder assemblies belongs. The terminology used in the description of the mausoleum with sealed cylinder assemblies herein is for describing particular embodiments only and is not intended to be limiting of the mausoleum with sealed cylinder assemblies. As used in the description of the mausoleum with sealed cylinder assemblies and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the mausoleum with sealed cylinder assemblies. Notwithstanding that the numerical ranges and parameters setting forth the broad scope of the mausoleum with sealed cylinder assemblies are approximations, the numerical values set forth in the specific examples are reported as precisely as possible. Any numerical values, however, inherently contain certain errors necessarily resulting from error found in their respective measurements.

In accordance with illustrated embodiments, the description and figures disclose a mausoleum having a plurality of compartments configured to house sealed cylinder assemblies (hereafter "mausoleum"). Generally, the mausoleum and the cylinder assemblies are formed from metallic materials configured to provide extended resistance to weather and seismic activities.

The term "mausoleum", as used herein, is defined to mean any structure configured for housing the burial space of one or more deceased persons.

Figure 1:
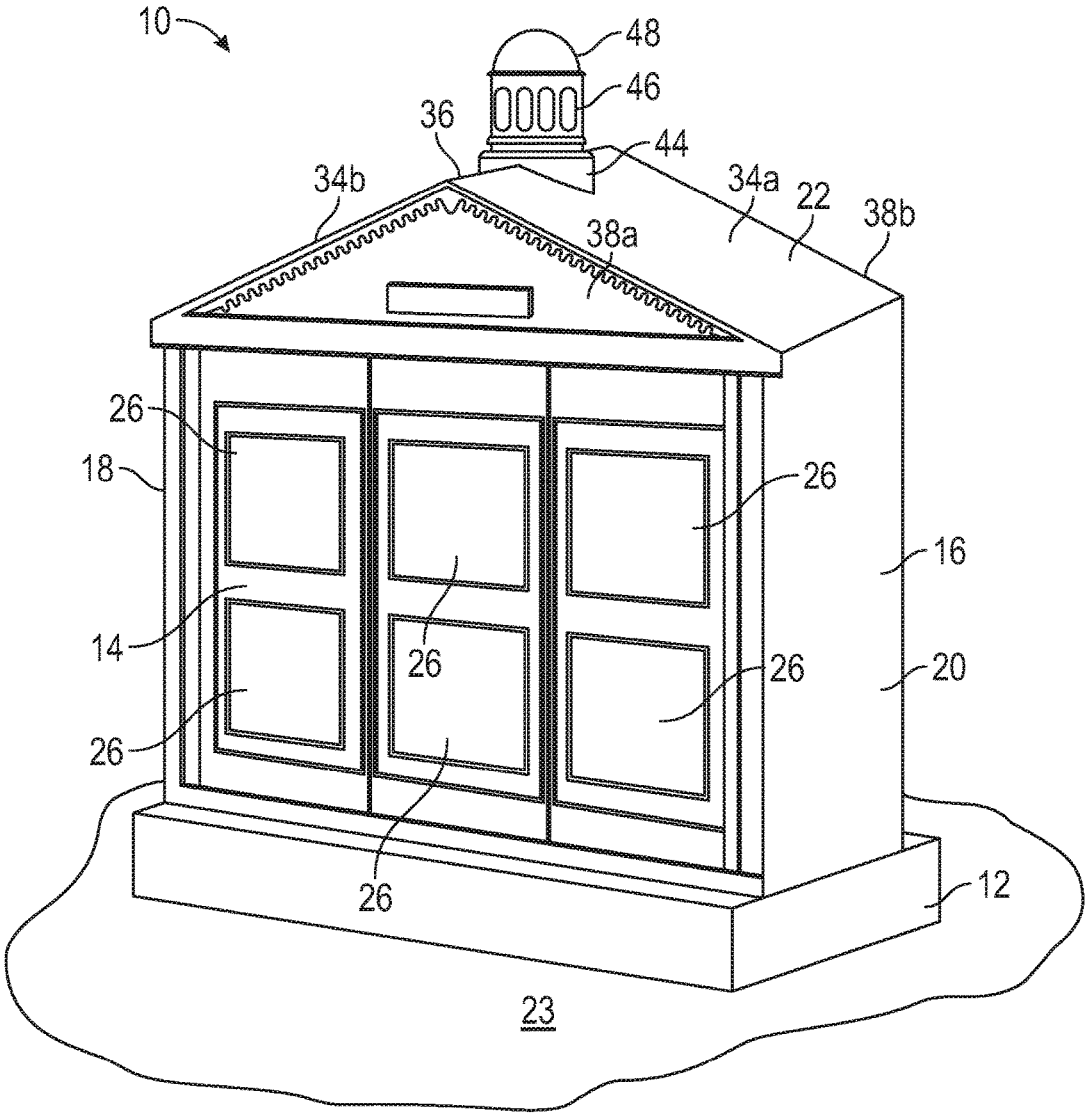
FIG. 1 is a perspective view of a first embodiment of a mausoleum.

Referring now to FIG. 1, one non-limiting embodiment of a mausoleum is shown schematically at 10. The mausoleum 10 is configured with a plurality of compartments, each equipped to house the burial space of one or more deceased persons. The mausoleum 10 includes a base 12, a front wall 14, a rear wall 16, a first side wall 18, a second side wall 20 and a roof structure 22. The base 12, walls 14, 16, 18, 20 and roof structure 22 cooperate to enclose the plurality of compartments.

Referring again to FIG. 1, the base 12 is configured to connect the mausoleum 10 to a ground area 23, and further configured to support the mausoleum 10 such that the weight of the mausoleum 10 is transferred to the ground area 23. In the illustrated embodiment, the base 12 has the form of a slab-on-grade foundation, that is, the weight of the mausoleum 10 is transferred to the ground area 23 through a concrete slab positioned at or near the surface of the ground area 23. However, in other embodiments, the base 12 can have other forms, including the non-limiting examples of footers, impact driven piles, drilled shafts, caissons, helical piles, geo-piers and earth stabilized columns, sufficient to connect the mausoleum 10 to the ground area 23, and further configured to support the mausoleum 10 such that the weight of the mausoleum 10 is transferred to the ground area 23.

Referring again to FIG. 1, the front wall 14 is configured for several functions, including partially defining an internal space (not shown) within the mausoleum 10, carrying a portion of the weight of the mausoleum 10 and providing shelter to a plurality of compartments located within the internal space of the mausoleum 10. In the illustrated embodiment, the front wall 14 is formed from a plurality of removable panels 26 attached to a first framework 28 (as shown in FIG. 2). However, in other embodiments, the front wall 14 can be formed from other structures, such as the non-limiting example of a combination of removable panels and stationary panels attached to the first framework 28 sufficient to define an internal space within the mausoleum 10, carry a portion of the weight of the mausoleum 10 and provide shelter to a plurality of compartments located within the internal space of the mausoleum 10.

Figure 2A:
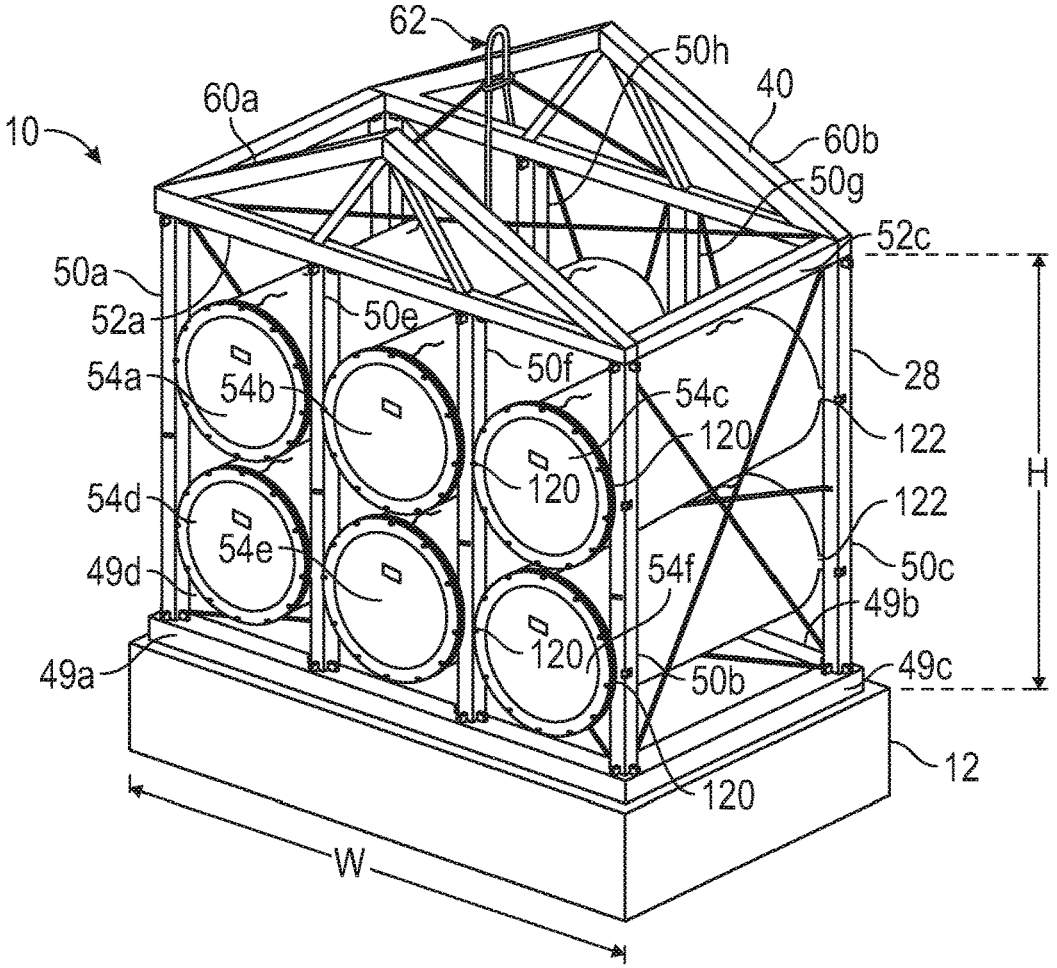
FIG. 2A is a perspective view of a base, first framework and second framework of the mausoleum of FIG. 1.
Figure 2B:
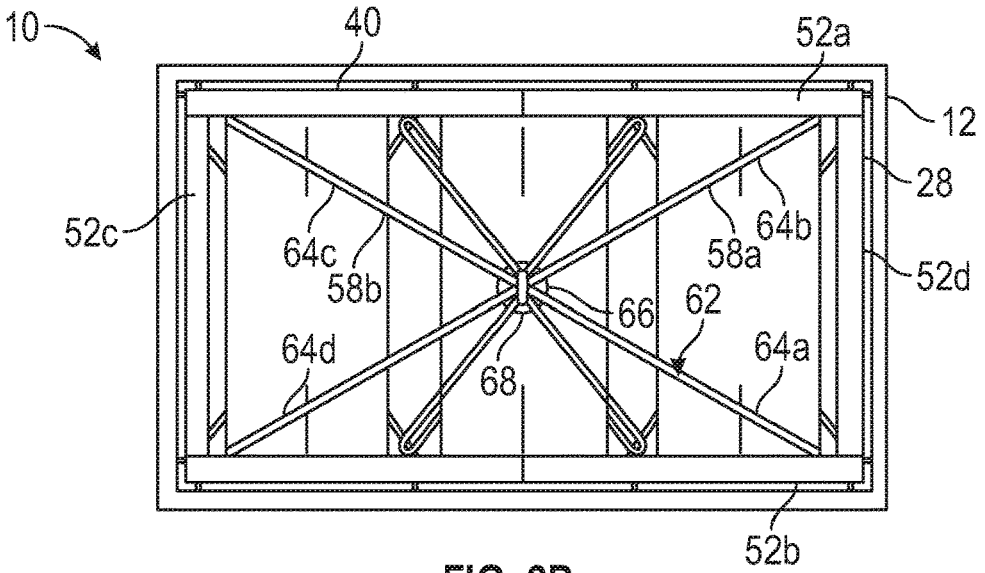
FIG. 2B is a plan view of the base and second framework of the mausoleum of FIG. 1.
Figure 2D:
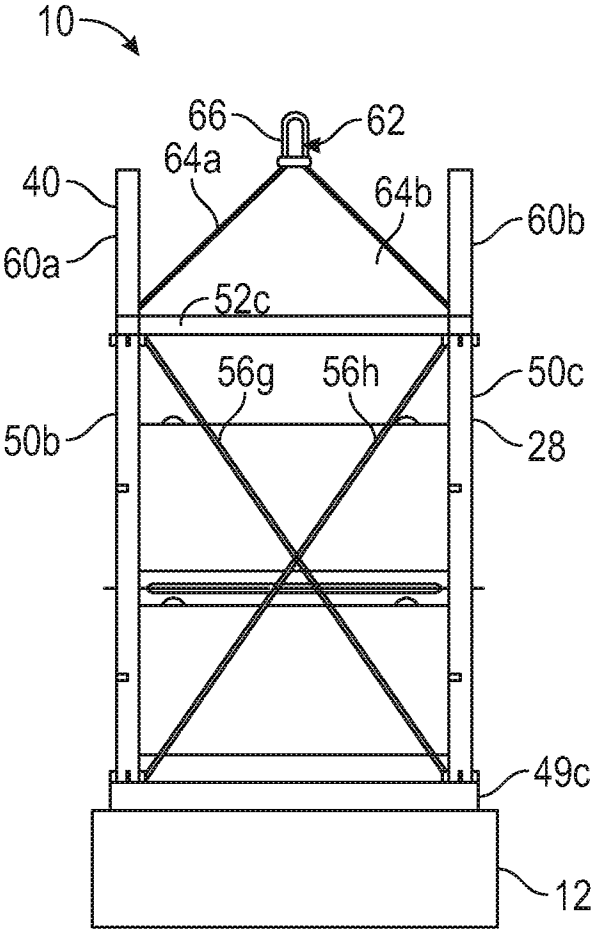
FIG. 2D is a side view, in elevation, of the base, first framework and second framework of the mausoleum of FIG. 1.
Figure 2C:
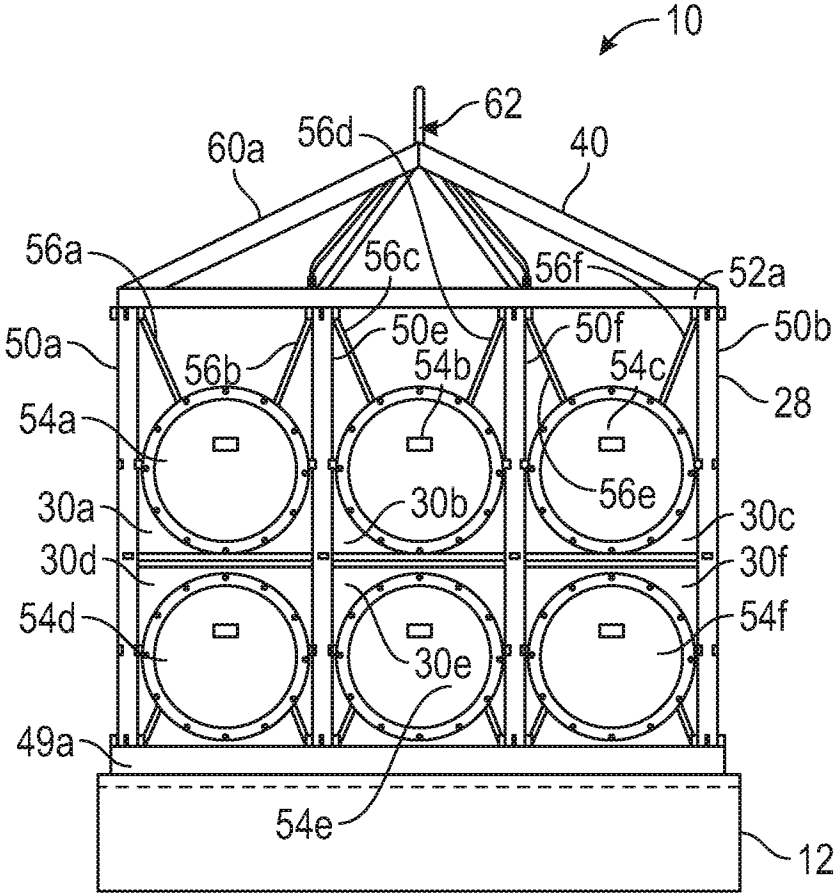
FIG. 2C is a front view, in elevation, of the base, first framework and second framework of the mausoleum of FIG. 1.

Referring again to FIG. 1, the removable panels 26 are arranged in rows and columns, such that the removable panels 26 cover a front portion of a plurality of compartments 30*a*-30*f* (as shown in FIG. 2C), also arranged in corresponding rows and columns. Accordingly, removal of a removable panel 26 provides access to an associated compartment 30*a*-30*f*. It should be appreciated that in other embodiments, the removable panels 26 can have other arrangements, such as for example, offset arrangements, sufficient to cover a front portion of a plurality of compartments 30*a*-30*f*.

Referring again to FIG. 1, the rear wall 16 is formed from a plurality of removable panels (not shown) configured to define an internal space within the mausoleum 10, carry a portion of the weight of the mausoleum 10 and provide shelter to a plurality of compartments located within the internal space of the mausoleum 10. In the illustrated embodiment, the removable panels forming the rear wall 16 are the same as, or similar to, the removable panels 26 forming the front wall 14. However, in other embodiments, the removable panels forming the rear wall 16 can be different from the removable panels 26 forming the front wall 14 sufficient to define an internal space within the mausoleum 10, carry a portion of the weight of the mausoleum 10 and provide shelter to a plurality of compartments located within the internal space of the mausoleum 10.

Referring again to FIG. 1, the first and second side walls 18, 20 are configured for several functions, including partially defining an internal space (not shown) within the mausoleum, carrying a portion of the weight of the mausoleum 10 and providing shelter to a plurality of compartments located within the internal space of the mausoleum 10. In the illustrated embodiment, the first and second side walls 18, 20 are formed from a plurality of panels permanently attached to the first framework 28. However, in other embodiments the first and second side walls 18, 20 can be formed from other structures, such as the non-limiting example of a combination of removable panels and permanent panels, sufficient to define an internal space within the mausoleum 10, carry a portion of the weight of the mausoleum 10 and provide shelter to a plurality of compartments located within the internal space of the mausoleum 10.

Referring again to the embodiment illustrated in FIG. 1, the front wall removable panels 26, rear wall removable panels, and first and second side walls 18, 20 are formed from aesthetically pleasing and weather-resistant exterior materials, such as for example stone. However, in other embodiments, the front wall removable panels 26, rear wall removable panels, and first and second side walls 18, 20 can be formed from other aesthetically pleasing and weather-resistant exterior materials or combinations of aesthetically pleasing and weather-resistant exterior materials, such as the non-limiting examples of concrete panels or panels clad in metallic materials.

In still other embodiments, the front wall removable panels 26, rear wall removable panels, and first and second side walls 18, 20 can have exterior finishes and/or exterior finish coatings configured to provide weather resistance. Non-limiting examples of weather resistant finishes and/or coatings include sealers and blends of synthetic elastomer polyester resins and polybutene.

Referring again to FIG. 1, the roof structure 22 is configured to sit atop the walls 14, 16, 18 and 20 and further configured to partially defining an internal space (not shown) within the mausoleum and providing shelter to a plurality of compartments located within the internal space of the mausoleum 10. In the embodiment illustrated in FIG. 1, the roof structure 22 includes opposing sloped roof planes 34*a*, 34*b* intersecting at a ridge 36 and supported by opposing front and rear sections 38*a*, 38*b*.

Referring again to FIG. 1, the roof planes 34*a*, 34*b* and the front and rear sections 38*a*, 38*b* are formed from a plurality of panels permanently attached to a second framework 40, as shown in FIGS. 2A-2D. However, in other embodiments the roof planes 34*a*, 34*b* and the front and rear sections 38*a*, 38*b* can be formed from other structures, such as the non-limiting example of a combination of removable panels and permanent panels, sufficient to define an internal space within the mausoleum 10 and provide shelter to a plurality of compartments located within the internal space of the mausoleum 10.

Referring again to FIG. 1, a cupola 42 is positioned atop the roof planes 34*a*, 34*b* at the ridge 36. The cupola 42 is configured to be removable, thereby providing access to the plurality of compartments located within the internal space of the mausoleum 10. In the illustrated embodiment, the cupola 42 includes a base 44, an outer circumferential wall 46 and a dome-shaped top 48.

Referring again to the embodiment illustrated in FIG. 1, the base 44, outer circumferential wall 46 and dome-shaped top 48 of the cupola 42 are formed from aesthetically pleasing and weather-resistant exterior materials, such as for example stone. However, in other embodiments, the base 44, outer circumferential wall 46 and dome-shaped top 48 can be formed from other aesthetically pleasing and weather-resistant exterior materials or combinations of aesthetically pleasing and weather-resistant exterior materials, such as the non-limiting examples of concrete panels or panels clad in metallic materials.

In still other embodiments, the base 44, outer circumferential wall 46 and dome-shaped top 48 can have exterior finishes and/or exterior finish coatings configured to provide weather resistance. Non-limiting examples of weather resistant finishes and/or coatings include sealers and blends of synthetic elastomer polyester resins and polybutene.

Referring now to FIGS. 2*a*-2*d*, the first framework 28 includes a front footer member 49*a*, a rear footer member 49*b*, side footer members 49*c*, 49*d*, corner posts 50*a*-50*d*, spaced apart main posts 50*e*-50*h*, a front header member 52*a*, a rear header member 52*b* and side header members 52*c*, 52*d*. The footer members 49*a*-49*d* are configured to support the corner posts 50*a*-50*d* and the spaced apart main posts 50*e*-50*h* and further configured to support the walls 14, 16, 18 and 20 and the roof structure 22. The corner posts 50*a*-50*d* and the main posts 50*e*-50*h* are configured to support a plurality of cylinder assemblies 54*a*-54*f*, each positioned in the corresponding compartment 30*a*-30*f*. The corner posts 50*a*-50*d* and the main posts 50*e*-50*h* are further configured to support the walls 14, 16, 18 and 20 and the roof structure 22. The header members 52*a*-52*d* are configured to support the roof structure 22.

In the embodiment illustrated in FIG. 2, the footer members 49*a*-49*d*, corner posts 50*a*-50*d*, main posts 50*e*-50*h* and header members 52*a*-52*d* are formed from stainless steel, 6.0 inch square tubing. The use of stainless steel advantageously allows the first framework 28 to support the walls 14, 16, 18 and 20 and the roof structure 22, to be weather resistant and further allows the first framework 28 to resist seismic activity. However, it should be appreciated that in other embodiments, the footer members 49*a*-49*d*, corner posts 50*a*-50*d*, main posts 50*e*-50*h* and header members 52*a*-52*d* can be formed from other materials or combinations of materials sufficient to support the walls 14, 16, 18 and 20 and the roof structure 22, to be weather resistant and further allows the first framework 28 to resist seismic activity.

Referring now to FIGS. 2C and 2D, the first framework 28 includes a plurality of vertically-oriented bracing members 56*a*-56*h* extending diagonally between adjacent corner posts 50*a*, 50*d* and 50*b*, 50*c* and between adjacent corner and main posts 50*c*, 50*f* and 50*d*, 50*e* and between adjacent main posts 50*e*, 50*f*. The use of the vertically-oriented bracing members 56*a*-56*h* on the sides and back of the first framework advantageously provides structural stability for the first framework 28 in front to back, side to side and top to bottom directions. In a similar manner, the first framework 28 includes a plurality of horizontally-oriented bracing members 58*a*, 58*b* that extend diagonally from the first side wall 16 to the second side wall 18. The horizontally-oriented bracing members 58*a*, 58*b* are configured to provide structural stability for the first framework 28 in front to back and side to side directions.

In the embodiment illustrated in FIGS. 2*a*-2*d*, the bracing members 56*a*-56*h*, 58*a*, 58*b* are formed from stainless steel, 2.0 inch angle iron. The use of stainless steel advantageously allows the bracing members 56*a*-56*h*, 58*a*, 58*b* to provide structural stability for the walls 14, 16, 18 and 20 and the roof structure 22, to be weather resistant and further allows the first framework 28 to resist seismic activity. However, it should be appreciated that in other embodiments, the bracing members 56*a*-56*h*, 58*a*, 58*b* can be formed from other materials or combinations of materials sufficient to support the walls 14, 16, 18 and 20 and the roof structure 22, to be weather resistant and further allows the first framework 28 to resist seismic activity.

Referring again to FIGS. 2A-2D, the second framework 40 includes opposing truss structures 60*a*, 60*b*. The truss structures 60*a*, 60*b* are configured to support the roof planes 34*a*, 34*b* and the front and rear sections 38*a*, 38*b*. In the illustrated embodiment, the truss structures 60*a*, 60*b* are formed from stainless steel material and can have any desired structure sufficient to support the roof planes 34*a*, 34*b* and the front and rear sections 38*a*, 38*b*. The use of stainless steel advantageously allows the truss structures 60*a*, 60*b* to support to support the roof planes 34*a*, 34*b* and the front and rear sections 38*a*, 38*b*, to be weather resistant and further allows the truss structures 60*a*, 60*b* to resist seismic activity. However, it should be appreciated that in other embodiments, the truss structures 60*a*, 60*b* can be formed from other materials or combinations of materials sufficient to support the roof planes 34*a*, 34*b* and the front and rear sections 38*a*, 38*b*, to be weather resistant and further allows the truss structures 60*a*, 60*b* to resist seismic activity.

Referring again to FIGS. 2A-2D, a hoist framework 62 extends vertically in an upward direction from the headers 52*a*-52*d*. The hoist framework 62 is configured to provide a lift point for hoisting the mausoleum 10 from the base 12. Once the mausoleum 10 is hoisted, the mausoleum 10 can be readily moved to other locations. The hoist framework 62 includes extension members 64*a*-64*d* and a hoist point 66. A first end of the extension members 64*a*-64*d* is connected to the associated header 52*a*-52*d* and the opposing ends of the extension members 64*a*-64*d* is connected to the hoist point 66. The extension members 64*a*-64*d* and the hoist point 66 can have any desired structure and can be formed from any desired material or combination of materials sufficient to provide a lift point for hoisting the mausoleum 10 from the base 12.

Referring again to FIGS. 2A-2D, a hoist framework 62 can further be configured for hoisting just the second framework 40. In this scenario, the first framework 28 remains connected to the base 12. By removing the second framework 40, access to the compartments 30*a*-30*f* and the cylinder assemblies 54*a*-54*f* within the compartments 30*a*-30*f* can be achieved.

Referring now to FIG. 2B, optionally the base 12 can be fitted with a floor drain 68. The floor drain 68 extends through the base 12 and is configured to convey water formed on the interior surface of the base 12 away from the interior space of the mausoleum 10. The floor drain 68 can have any desired structure sufficient to convey water formed on the interior surface of the base 12 away from the interior space of the mausoleum 10. However, it should be appreciated that the floor drain 68 is optional and not required for operation of the mausoleum 10.

Figure 3:
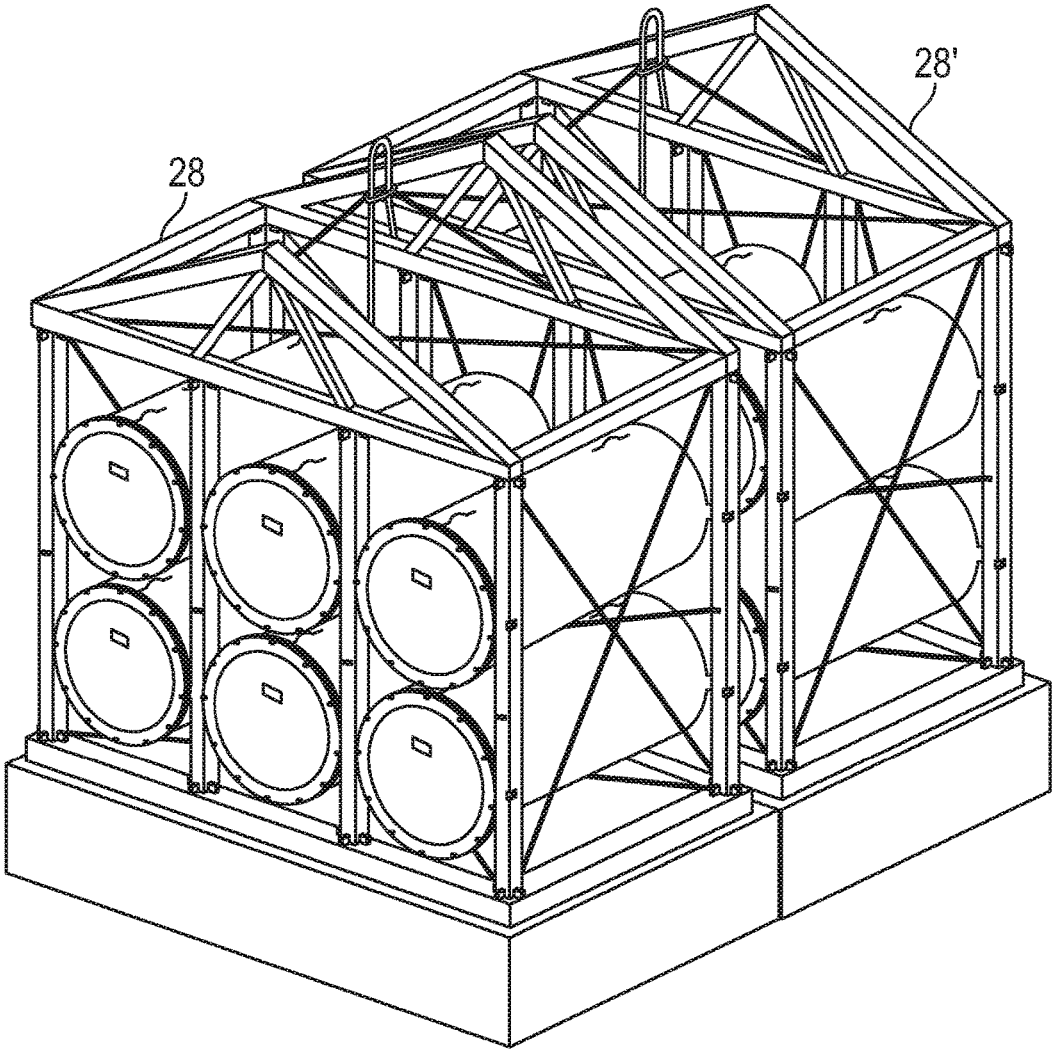
FIG. 3 is a perspective view of a second embodiment of a mausoleum.

Referring again to the embodiment illustrated in FIGS. 2A-2D, the first framework 28 has a modular design. That is, a width W and/or height H of the first framework 28 can be increased as desired to increase the number of compartments. It should also be apparent that in other embodiments a plurality of frameworks 28, 28' can be located within the walls 14, 16, 18 and 20 and the roof structure 22 to increase the number of compartments and form a more square footprint as shown in FIG. 3. The plurality of frameworks 28, 28' can be arranged in any desired manner, including the illustrated non-limiting example of a back-to-back arrangement.

Referring again to the embodiment illustrated in FIGS. 2A-2D, the framework 28 is configured for fabrication prior to arrival at an erection site. The fabricated framework and the base, walls and roof structure are subsequently assembled on-site. However, it should be appreciated that in other embodiments, the framework 28 can be fabricated at the erection site.

Figure 4A:
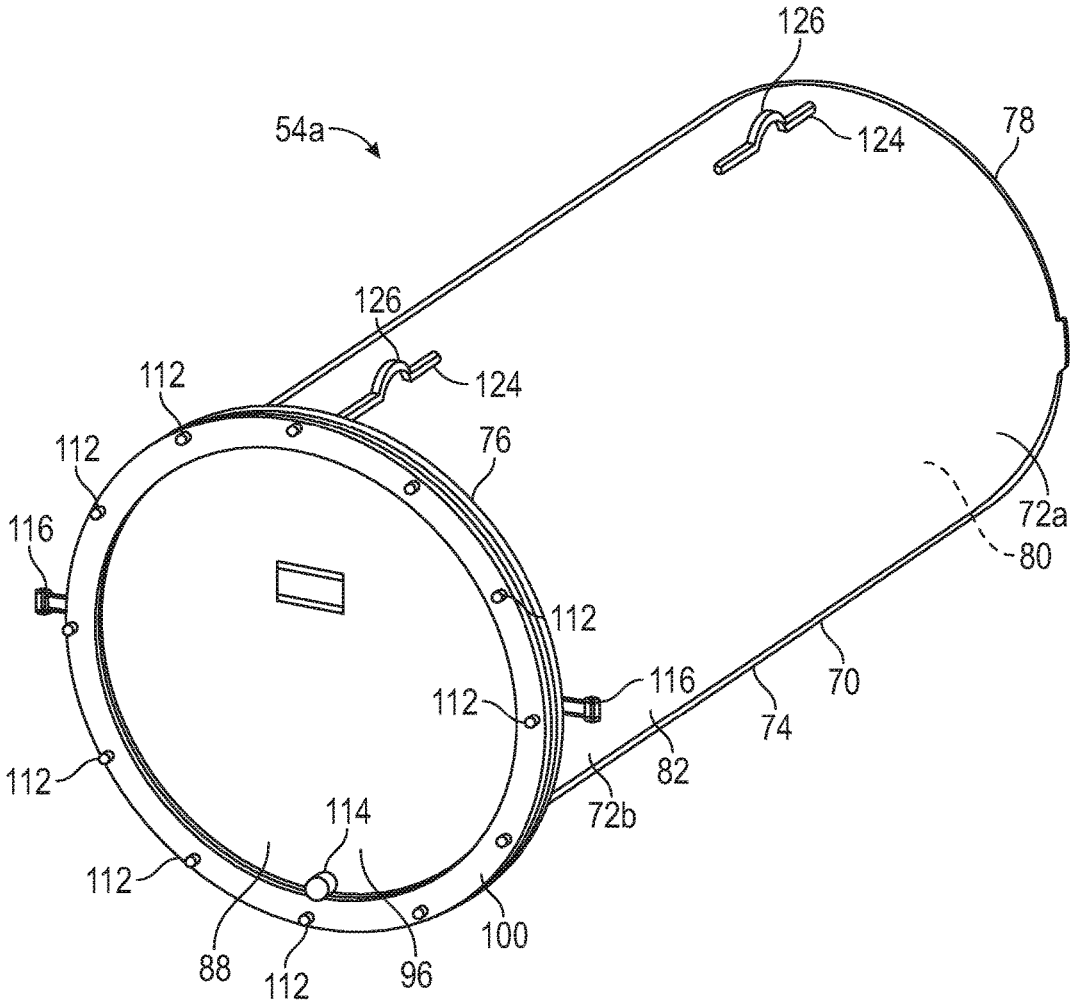
FIG. 4A is a perspective view of a cylinder assembly of the mausoleum of FIG. 1.
Figure 4B:
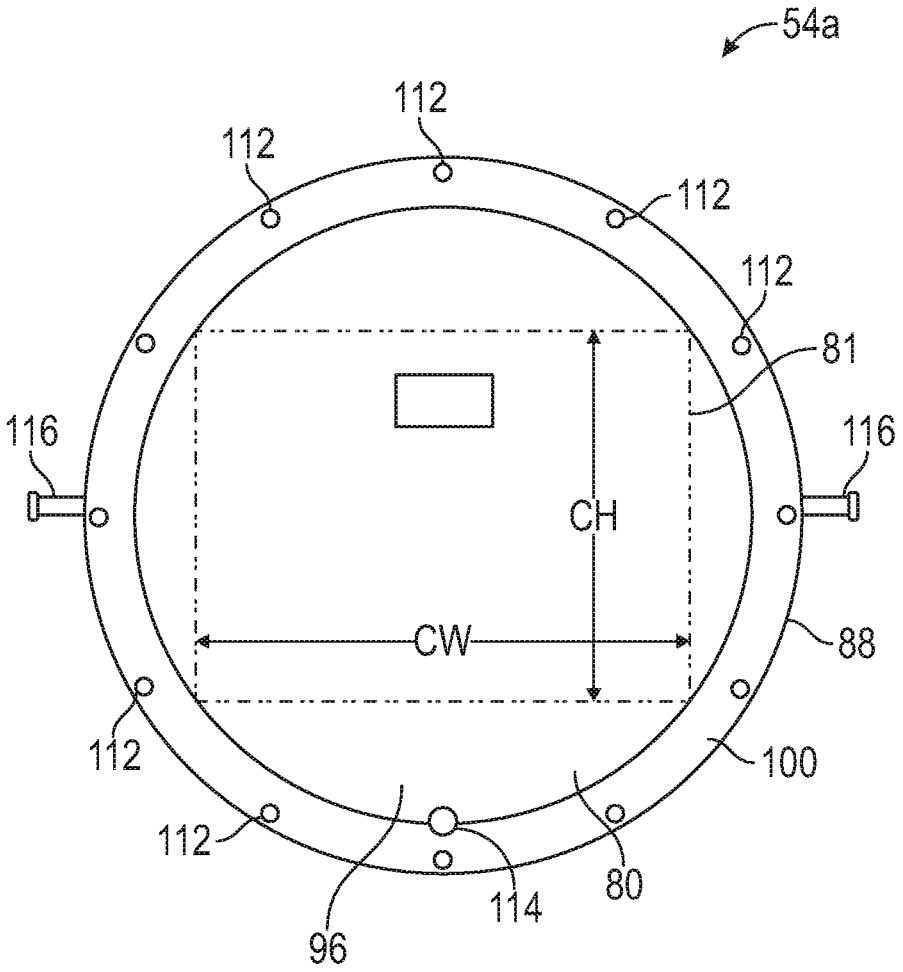
FIG. 4B is a front view, in elevation, of the cylinder assembly of FIG. 4A.
Figure 4C:
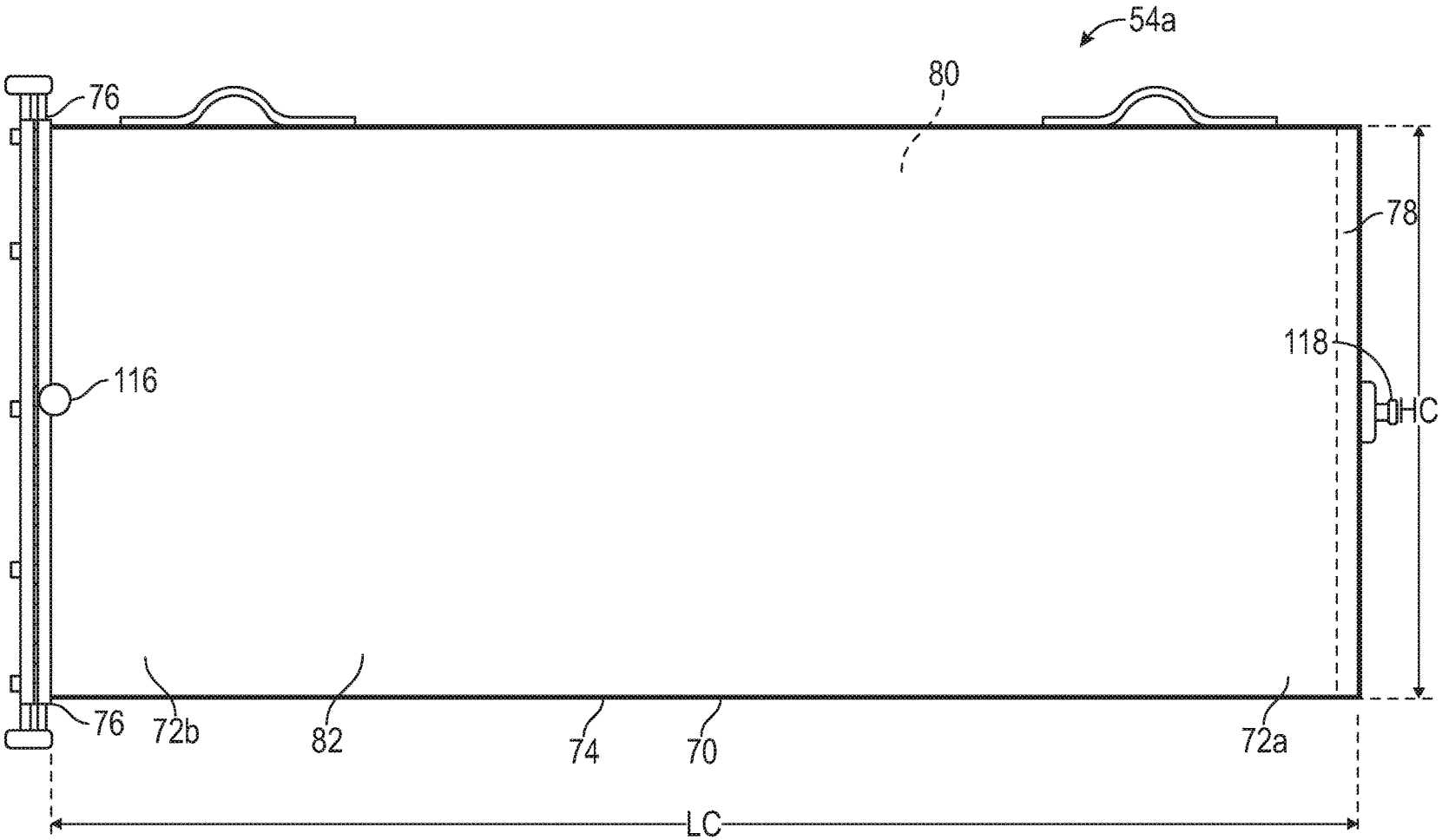
FIG. 4C is a side view, in elevation, of the cylinder assembly of FIG. 4A.

Referring again to FIG. 2A, the mausoleum 10 includes a plurality of compartments 30*a*-30*f*, each configured to house a sealed cylinder assembly 54*a*-54*f*. Referring now to FIGS. 4A-4C, a cylinder assembly 54*a* is illustrated. The cylinder assembly 54*a* is representative of the cylinder assemblies 54*b*-54*f*. The cylinder assembly 54*a* is configured as a sealable vessel for receiving the remains of one or more deceased persons. The cylinder assembly 54*a* includes a main body 70 having a circumferential wall 74. In the illustrated embodiment, the circumferential wall 74 has the cross-sectional shape of a circle, thereby resulting in the main body 70 having the form of a hollow cylinder. In alternate embodiments, the main body 70 can have other cross-sectional shapes, such as the non-limiting example of a rectangular cross-sectional shape, resulting in the main body 70 having other forms, such as for example a rectangular box shape.

Referring again to FIGS. 4A-4C, the cylinder assembly 54*a* also includes a front flange 76 and an opposing rear wall 78. The circumferential wall 74, front flange 76 and opposing rear wall 78 cooperate to form an interior cavity 80 therewithin. Referring now to FIG. 4C, the interior cavity 80 has a length LC and a height HC. The length LC and height HC are configured such that the resulting cross-section of the interior cavity 80 can accommodate standard size coffins. In the illustrated embodiment, the length LC is in a range of from about 80.0 inches to about 100.0 inches and the height HC is in a range of from about 35.0 inches to about 45.0 inches. Referring now to FIG. 4B, a coffin 81 is illustrated within the interior cavity 80. The coffin 81 can have a coffin width CW and a coffin height CH in a range of from about 20.0 inches to about 35.0. However, it should be appreciated that in other embodiments, the length LC of the interior cavity 80 can be less than about 80.0 inches or more than about 100.0 inches and the height HC of the interior cavity can be less than about 35.0 inches or more than about 45.0 inches, resulting in the cylinder assembly 54*a* having the capacity to accommodate coffins of other sizes.

Referring again to FIG. 4C, the rear wall 78 is connected to the outer circumferential wall 74 at a first end 72*a* of the main body 70 in a manner such as to prohibit the flow of fluids and gasses from the environment to the interior cavity 80 and from the interior cavity 80 to the environment. In the illustrated embodiment, the rear wall 78 is connected to the outer circumferential wall 74 by welding. Alternatively, the rear wall 78 can be connected to the outer circumferential wall 74 by other processes or with structures, mechanisms and devices sufficient to prohibit the flow of fluids and gasses from the environment to the interior cavity 80 and from the interior cavity 80 to the environment.

Figure 4D:
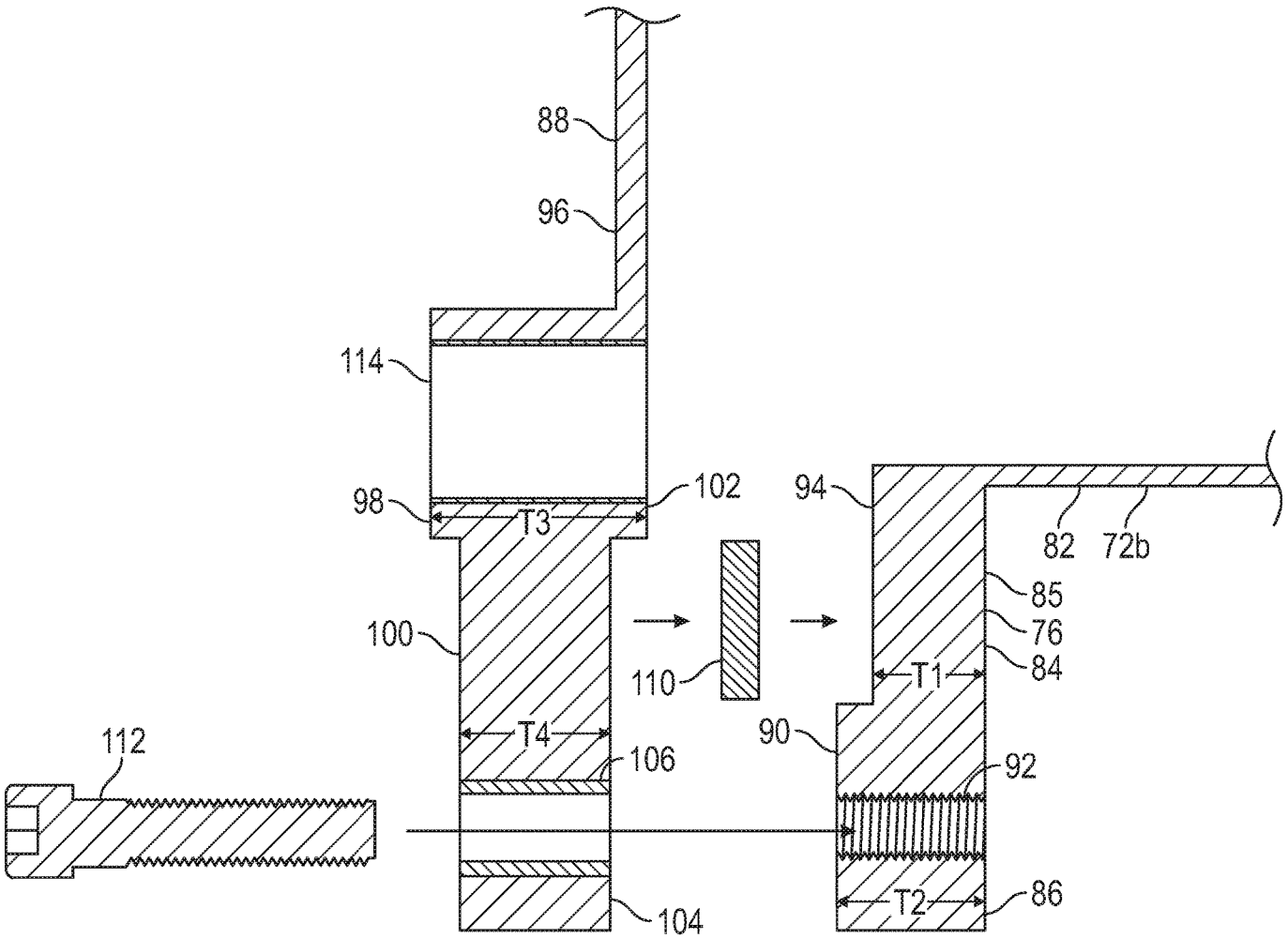
FIG. 4D is an exploded side view, in elevation, of a front flange, cover and seal of the cylinder assembly of FIG. 4A.
Figure 4E:
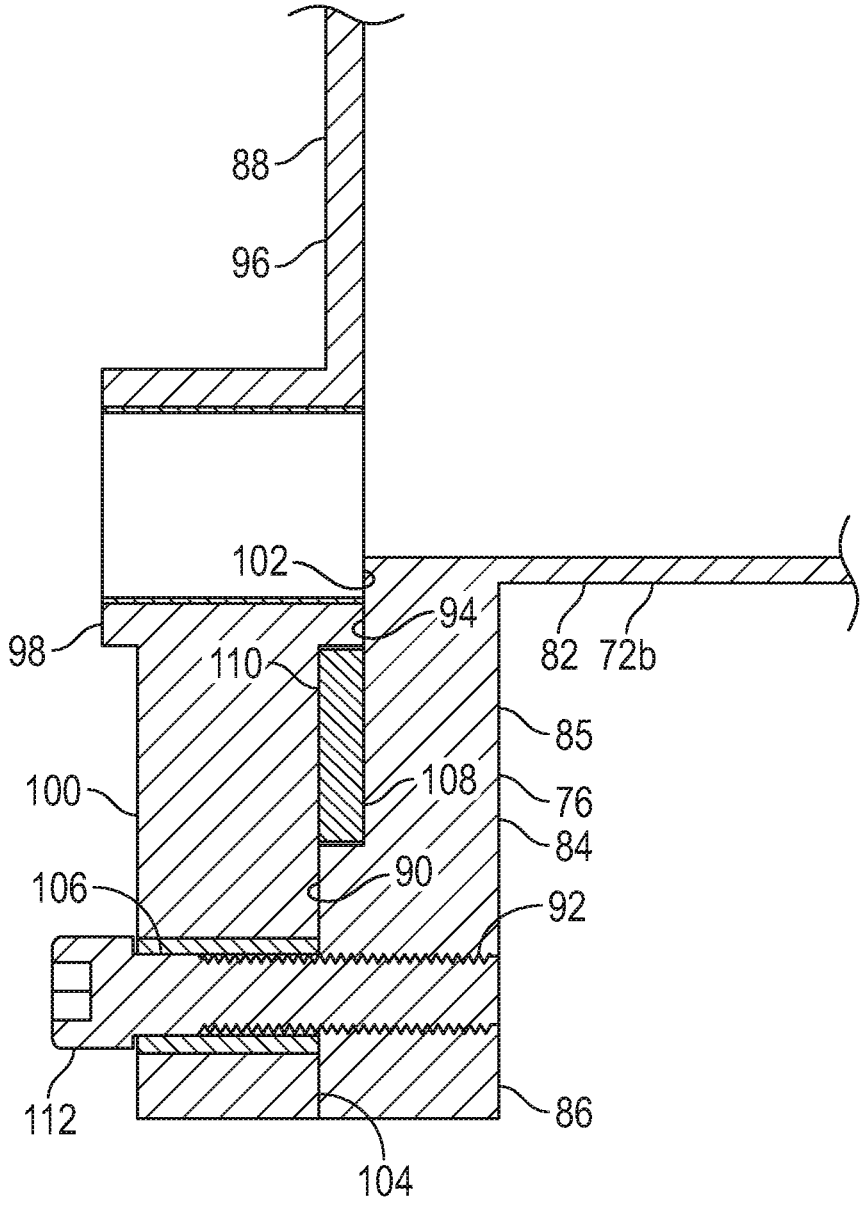
FIG. 4E is an assembled side view, in elevation, of a front flange, cover and seal of the cylinder assembly of FIG. 4A.

Referring now to FIGS. 4D and 4E, the front flange 76 extends from an outer surface 82 of the circumferential wall 74 at a second end 72*b* of the main body 70. The front flange 76 includes a leg 84 configured to be substantially perpendicular to the circumferential wall 74. The leg 84 includes an inner segment 85 and an outer segment 86. The inner segment 85 has a thickness T1 and the outer segment 86 has a thickness T2. In the illustrated embodiment, the thickness T1 is smaller than the thickness T2, such that the outer segment 86 extends from the inner segment 85 in a direction toward a cover 88. The outer segment 86 has a front face 90 configured to receive a portion of the cover 88 and a plurality of spaced apart and threaded apertures 92 extending therethrough. The inner segment 85 has a front face 94. The front face 94 will be discussed in more detail below.

Referring now to FIGS. 4D and 4E, the cover 88 includes a central segment 96 extending inwardly from an inner rim segment 98. An outer rim segment 100 extends outwardly from the inner rim segment 98. The inner rim segment 98 has a thickness T3 and the outer rim segment 100 has a thickness T4. In the illustrated embodiment, the thickness T4 is smaller than the thickness T3, such that the inner rim segment 98 extends from the cover 88 in a direction toward the front flange 76. The inner rim segment 98 has a rear face 102 configured to seat against a portion of the front face 94 of the inner segment 85 of the leg 84. The outer rim segment 100 includes a rear face 104 configured to seat against a portion of the front face 90 of the outer segment 86 of the leg 84. The outer rim segment 100 includes a plurality of spaced apart apertures 106 extending therethrough. The apertures 106 in the outer rim segment 100 of the cover 88 are configured to align with the threaded apertures 92 in the front flange 76.

Referring now to FIG. 4E, the cover 88 is shown in an assembled state with the front flange 76. In the assembled state, a portion of the rear face 102 of the inner rim segment 98 of the cover 88 seats against a portion of the front face 94 of the inner segment 85 of the leg 84 and a portion of the rear face 104 of the outer rim segment 100 of the cover 88 seats against a portion of the front face 90 of the outer segment 86 of the leg 84. In the assembled state, an annular gap 108 is formed between the rear face 104 of the outer rim segment 100 of the cover 88 and the front face 94 of the inner segment 85 of the leg 84.

Referring now to FIGS. 4D and 4E, an annular seal 110 is positioned in the annular gap 108. The annular seal 110 is configured to prohibit the flow of fluids and gasses from the environment to the interior cavity 80 of the cylinder assembly 54*a* and from the interior cavity 80 of the cylinder assembly 54 to the environment. In the illustrated embodiment, the annular seal 110 has the form of a metallic O-ring. However, it should be appreciated that in other embodiments, the annular seal 110 can have other forms sufficient to prohibit the flow of fluids and gasses from the environment to the interior cavity 80 of the cylinder assembly 54*a* and from the interior cavity 80 of the cylinder assembly 54 to the environment.

In the illustrated embodiment, the cover 88, outer circumferential wall 74, front flange 76 and opposing rear wall 78 are formed from stainless steel materials configured to be weather resistant and resist seismic activity. In alternate embodiments, the cover 88, outer circumferential wall 74, front flange 76 and opposing rear wall 78 can be formed from other materials configured to be weather resistant and resist seismic activity.

Referring again to FIGS. 4D and 4E, the cover 88 is secured to the front flange 76 by fasteners 112 extending through the apertures 108 in the outer rim segment 100 of the cover 88 and into the threaded apertures 92 in the front flange 76. In the illustrated embodiment, the fasteners 112 are threaded bolts. However, in other embodiments, the fasteners 112 can be other structures, mechanisms and devises sufficient to attach the cover 88 to the front flange 76.

Referring again to the embodiment shown in FIGS. 4D and 4E, the seal 110 is positioned in a radial direction between the outer segment 86 of the leg 84 and the inner rim segment 98 of the cover 88. Without being held to the theory, it is believed the radial positioning of the seal 110 between the outer segment 86 of the leg 84 and the inner rim segment 98 of the cover 88 provides a superior seal than seals positioned to be radially concentric with the plurality of fasteners 112. Advantageously, it is believed the sealing provisions of the cylinder assembly 54*a*, namely the sealing of the rear wall 78 to the circumferential wall 74 and the sealing of the cover 88 to the front flange 76 provide the interior cavity 80 with a sealed state that can last for an extended period of time. In certain instances, the sealed state within the interior cavity 80 of the cylinder assembly 54*a* can extend for periods of time up to or beyond 200 years.

Referring again to FIGS. 4A, 4B and 4D, the cylinder assembly 54*a* includes a drain port 114. The drain port 114 is configured to facilitate removal of water and/or gases from the interior cavity 80 of the cylinder assembly 54*a* and further configured to prohibit the flow of fluids and gasses from the environment to the interior cavity 80 of the cylinder assembly 54*a* and from the interior cavity 80 of the cylinder assembly 54 to the environment when not in use. Optionally, the drain port 114 can be fitted with structures, mechanisms and devices (not shown), such as the non-limiting example of a vacuum device, configured to withdraw water and gasses from the interior cavity 80. The drain port 114 can have any desired configuration and structure, sufficient to facilitate removal of water and/or gases from the interior cavity 80 of the cylinder assembly 54*a* and further configured to prohibit the flow of fluids and gasses from the environment to the interior cavity 80 of the cylinder assembly 54*a* and from the interior cavity 80 of the cylinder assembly 54 to the environment when not in use.

Referring now to FIGS. 4A, 4B and 4C, the cylinder assembly 54*a* includes a plurality of front support pins 116 and a plurality of rear support pins 118. The front support pins 116 are configured for insertion into corresponding front receiving fixtures 120, as shown in FIG. 2A, and the rear support pins 118 are configured for insertion into corresponding rear receiving fixtures 122, also shown in FIG. 2B. The front and rear support pins 116, 118 and the front and rear receiving fixtures 120, 122 cooperate to support the cylinder assemblies 54*a*-54*f* as the cylinder assemblies 54*a*-54*f* are positioned in the first framework 28. The front and rear support pins 116, 118 and the front and rear receiving fixtures 120, 122 further cooperate to maintain the cylinder assemblies 54*a*-54*f* in a substantially horizontal orientation within the first framework 28 while allowing ready removal of the cylinder assemblies 54*a*-54*f* from the first framework.

Referring again to embodiment shown in FIGS. 4A, 4B and 4C, the front support pins 116 have the form of metallic dowels and extend from an approximate midpoint of the circumferential wall 74 at the second end 72*b* of the cylinder assembly 54*a*. The rear support pins 118 also have the form of metallic dowels and extend from an approximate midpoint of the rear wall 78 at the first end 72*a* of the cylinder assembly 54*a*. However, it should be appreciated that in other embodiments, the front and rear support pins 116, 118 can have other forms and can be positioned in other locations sufficient to support the cylinder assemblies 54*a*-54*f* within the first framework 28 and maintain the cylinder assemblies 54*a*-54*f* in a substantially horizontal orientation within the first framework 28 while allowing ready removal of the cylinder assemblies 54*a*-54*f* from the first framework.

Referring now to FIG. 4A, the cylinder assembly 54*a* includes a plurality of lift lugs 124. The lift lugs 124 are configured to facilitate movement of the cylinder assembly 54*a* by lifting devices, such as the non-limiting example of a crane (not shown). In the embodiment shown in FIG. 4A, the lift lugs 124 have the form of a metallic loop 126 attached to an upper surface of the circumferential wall 74 of the cylinder assembly 54*a*. The loop 126 is configured to receive a hook or lift cable extending from the lifting device. However, in other embodiments, the loop lift lugs 124 can have other forms and can be positioned in other locations sufficient to facilitate movement of the cylinder assembly 54*a* by lifting devices. While the illustrated embodiment shows a quantity of two lift lugs 124, in alternate embodiments, more or less than two lift lugs 124 can be used, sufficient to facilitate movement of the cylinder assembly 54*a* by lifting devices.

The principle and mode of operation of the mausoleum with sealed cylinder assemblies has been described in certain embodiments. However, it should be noted that the mausoleum with sealed cylinder assemblies may be practiced otherwise than as specifically illustrated and described without departing from its scope.

What is claimed is:

1. A mausoleum comprising:

a base;

a first framework supported by the base, the first framework including a plurality of corner posts, a plurality of main posts, a plurality of header members and a plurality of bracing members;

a plurality of cylinder assemblies supported by the first framework;

a second framework extending from the first framework, the second framework including a plurality of truss structures; and a roof structure supported by the plurality of truss structures; and a cupola extending from the second framework, wherein the cupola is removable from the second framework to allow access to a plurality of compartments defined by the first framework, with each of the compartments configured to support a cylinder assembly;

wherein the plurality of cylinder assemblies, corner posts, main posts, header members, bracing members and truss structures are formed from weather resistant and seismic activity resistant metallic materials.

2. The mausoleum of claim 1, wherein the metallic material is stainless steel.

3. The mausoleum of claim 1, wherein the cylinder assemblies are supported within the first framework in a substantially horizontal orientation.

4. The mausoleum of claim 1, wherein the cylinder assemblies include a plurality of lift lugs configured to receive lifting devices for removal of the cylinder assemblies from the first framework and for installing the cylinder assemblies in the first framework.

5. The mausoleum of claim 1, wherein the plurality of compartments are arranged in rows and columns.

6. The mausoleum of claim 1, wherein the second framework includes a hoist point configured to facilitate removal of the first framework and the second framework.

7. The mausoleum of claim 1, wherein the second framework includes a hoist point configured to facilitate removal of the second framework while leaving the first framework supported by the base.

8. The mausoleum of claim 1, wherein the first framework is covered by a plurality of removable panels.

9. The mausoleum of claim 1, wherein the bracing elements include vertically oriented bracing elements and horizontally oriented bracing elements.

10. The mausoleum of claim 1, wherein the base is configured to support a plurality of first frameworks arranged in back-to-back orientation.

11. A mausoleum comprising:

a base;

a first framework supported by the base, the first framework including a plurality of corner posts, a plurality of main posts, a plurality of header members and a plurality of bracing members;

a plurality of cylinder assemblies supported by the first framework, each of the cylinder assemblies includes a rear wall connected to a first end of a main body and a front flange connected to a second end of the main body, wherein the front flange includes an inner segment and an outer segment extending from the inner segment, wherein the inner segment has a thickness and the outer segment has a thickness, and wherein the thickness of the inner segment is less than the thickness of the outer segment;

a second framework extending from the first framework, the second framework including a plurality of truss structures; and a roof structure supported by the plurality of truss structures; and a cupola extending from the second framework;

wherein the plurality of cylinder assemblies, corner posts, main posts, header members, bracing members and truss structures are formed from weather resistant and seismic activity resistant metallic materials.

12. The mausoleum of claim 11, wherein a cover is attached to the front flange to provide a weather and seismic activity resistant seal.

13. The mausoleum of claim 11, wherein the outer segment has a front face configured to receive a portion of the cover.

14. The mausoleum of claim 11, wherein the inner segment includes a front face configured to receive a portion of the seal.

15. A mausoleum comprising:

a base;

a first framework supported by the base, the first framework including a plurality of corner posts, a plurality of main posts, a plurality of header members and a plurality of bracing members;

a plurality of cylinder assemblies supported by the first framework, each of the cylinder assemblies includes a front flange, each of the front flanges includes a cover, wherein each cover includes an inner rim segment and an outer rim segment extending from the inner rim segment, wherein each inner rim segment has a thickness and each outer rim segment has a thickness, and wherein the thickness of the inner rim segments is greater than the thickness of the outer rim segments;

a second framework extending from the first framework, the second framework including a plurality of truss structures; and a roof structure supported by the plurality of truss structures; and a cupola extending from the second framework;

wherein the plurality of cylinder assemblies, corner posts, main posts, header members, bracing members and truss structures are formed from weather resistant and seismic activity resistant metallic materials.

16. A mausoleum comprising:

a base;

a first framework supported by the base, the first framework including a plurality of corner posts, a plurality of main posts, a plurality of header members and a plurality of bracing members;

a plurality of cylinder assemblies supported by the first framework, wherein each of the cylinder assemblies includes a plurality of front support pins and a plurality of rear support pins, each of the front support pins supports corresponding front receiving fixtures located in the first framework and each of the rear support pins supports corresponding rear receiving fixtures located in the first framework, the front and rear support pins and the front and rear receiving fixtures support the cylinder assemblies as the cylinder assemblies are positioned in the first framework and maintain the cylinder assemblies in a substantially horizontal orientation within the first framework while allowing ready removal of the cylinder assemblies from the first framework;

a second framework extending from the first framework, the second framework including a plurality of truss structures; and a roof structure supported by the plurality of truss structures; and a cupola extending from the second framework;

wherein the plurality of cylinder assemblies, corner posts, main posts, header members, bracing members and truss structures are formed from weather resistant and seismic activity resistant metallic materials.

17. The mausoleum of claim 16, wherein the front and rear support pins have the structure of metallic dowels.

18. A mausoleum comprising:

a base;

a first framework supported by the base, the first framework including a plurality of corner posts, a plurality of main posts, a plurality of header members and a plurality of bracing members;

a plurality of cylinder assemblies supported by the first framework, each of the cylinder assemblies including a drain port configured to facilitate removal of water and gases from an interior cavity of the cylinder assembly;

a second framework extending from the first framework, the second framework including a plurality of truss structures; and a roof structure supported by the plurality of truss structures; and a cupola extending from the second framework;

wherein the plurality of cylinder assemblies, corner posts, main posts, header members, bracing members and truss structures are formed from weather resistant and seismic activity resistant metallic materials.

* * * * *